US008258438B2

(12) United States Patent
Davidson

(10) Patent No.: US 8,258,438 B2
(45) Date of Patent: Sep. 4, 2012

(54) CONDENSATION-FREE AND BACTERIA-FREE PAN SYSTEM

(76) Inventor: John B. Davidson, Vicksburg, MS (US)

( * ) Notice: Subject to any disclaimer, the term of this patent is extended or adjusted under 35 U.S.C. 154(b) by 542 days.

(21) Appl. No.: 12/585,205

(22) Filed: Sep. 8, 2009

(65) Prior Publication Data

US 2010/0059501 A1 Mar. 11, 2010

Related U.S. Application Data

(60) Provisional application No. 61/136,497, filed on Sep. 9, 2008.

(51) Int. Cl.
*H05B 3/68* (2006.01)
*H05B 3/02* (2006.01)
*B65D 85/00* (2006.01)

(52) U.S. Cl. ..... 219/465.1; 219/489

(58) Field of Classification Search .... 219/458.1–468.2, 219/489–491

See application file for complete search history.

(56) References Cited

U.S. PATENT DOCUMENTS

| | | | | |
|---|---|---|---|---|
| 3,603,241 | A | 9/1971 | Drucker | |
| 5,616,266 | A | 4/1997 | Cooper | |
| 6,247,517 | B1 | 6/2001 | Drifka et al. | |
| 6,252,204 | B1 | 6/2001 | Po-Hei | |
| 6,262,399 | B1 | 7/2001 | Lau et al. | |
| 6,399,924 | B1 | 6/2002 | Cai | |
| 6,485,118 | B2 | 11/2002 | Matus, Jr. | |
| 7,216,500 | B2 * | 5/2007 | Schwichtenberg et al. | 62/258 |
| 2003/0047086 | A1 | 3/2003 | Matus, Jr. | |
| 2005/0236387 | A1 | 10/2005 | Stockley | |
| 2006/0081593 | A1 | 4/2006 | Benoit et al. | |
| 2010/0051604 | A1 * | 3/2010 | Davidov et al. | 219/488 |

FOREIGN PATENT DOCUMENTS

| | | |
|---|---|---|
| DE | 20 2005 004 486 U1 | 7/2005 |
| JP | 3-066313 | 3/1991 |

* cited by examiner

*Primary Examiner* — Cuong Q Nguyen
(74) *Attorney, Agent, or Firm* — Richard C. Litman

(57) ABSTRACT

The condensation-free and bacteria-free pan system provides hygienic cover for a food preparation area. The system includes at least one pan having a top cover sheet, a heating element, a layer of thermal insulation and a bottom pan sheet. The top cover sheet is formed from a corrosion resistant material and is adapted for catching contaminants falling from overhead. The layer of thermal insulation is sandwiched between the top cover sheet and the heating element, and the bottom pan sheet is formed from a thermally conductive, corrosion resistant material, the bottom pan sheet having a lower wall and at least one sidewall. The top cover sheet, the layer of thermal insulation and the heating element are disposed above the bottom pan sheet to form a multilayer pan.

20 Claims, 4 Drawing Sheets

CONDENSATION-FREE AND BACTERIA-FREE PAN SYSTEM

CROSS-REFERENCE TO RELATED APPLICATION

This application claims the benefit of U.S. Provisional Patent Application Ser. No. 61/136,497, filed Sep. 9, 2008.

BACKGROUND OF THE INVENTION

1. Field of the Invention

The present invention relates to food pan, trays and the like, and particularly to a condensation-free and bacteria-free pan system that prevents condensation and kills bacteria over a production line in the food and beverage industry.

2. Description of the Related Art

Typically, food preparation services and industries, such as restaurants, meat processing plants, and poultry processing plants, for example, have a problem with condensation forming on overhead pipes, concrete ceilings, drop-ceiling panels and the like during normal operation. This condensation is often contaminated (and must be assumed to be contaminated for safety and hygienic reasons) and will instantly contaminate any surface upon which it makes contact. Additionally, other debris may fall from overhead, potentially contaminating a food preparation area. Recently, state and federal food inspectors have required, in some applications, that stainless steel plates or pans be placed overhead in a food preparation area in order to prevent contaminated condensation from accumulating, or to prevent debris from falling on the food preparation areas. These steel plates or pans, however, do not prevent the condensation from forming, but merely catch already-formed condensation. In most applications, the use of such plates or pans will actually cause an increase in condensation formation. Thus, the use of such steel plates or pans in overhead-type ceiling arrangements is not sanitary.

Thus, a condensation-free and bacteria-free pan system solving the aforementioned problems is desired.

SUMMARY OF THE INVENTION

The condensation-free and bacteria-free pan system provides hygienic cover for a food preparation area. The system includes at least one pan having a top cover sheet, a heating element, a layer of thermal insulation and a bottom pan sheet. The top cover sheet is formed from a corrosion resistant material and is adapted for catching contaminants falling from a ceiling. The layer of thermal insulation is sandwiched between a lower surface of the top cover sheet and an upper surface of the heating element, and the bottom pan sheet is formed from a thermally conductive, corrosion resistant material. The bottom pan sheet has a lower wall and at least one sidewall. The top cover sheet, the layer of thermal insulation and the heating element are disposed within the bottom pan sheet so that a lower surface of the heating element rests on an upper surface of the bottom pan sheet.

A controller is provided for powering the heating element, and the at least one pan is mounted above the food preparation area. Preferably, the controller actuates the heating element at random times, and also provides for user-selectable temperature control for controlling the temperature of the lower surface of the bottom pan sheet.

Preferably, the bottom pan sheet is rectangular, having a pair of laterally opposed sidewalls and a pair of longitudinally opposed sidewalls. One of the longitudinally opposed sidewalls thereof is substantially J-shaped to form a trough for receiving the contaminants. A drainage pipe is further provided, in communication with the trough for draining the contaminants. Preferably, the system includes a plurality of pans, with each drainage pipe draining into a single drainage conduit. Adjacent pans are secured to one another and, preferably, one of the laterally opposed sidewalls of each pan has a substantially inverted J-shape so that an upper angled flanged portion thereof extends over the corresponding lateral sidewall of an adjacent one of the pans.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
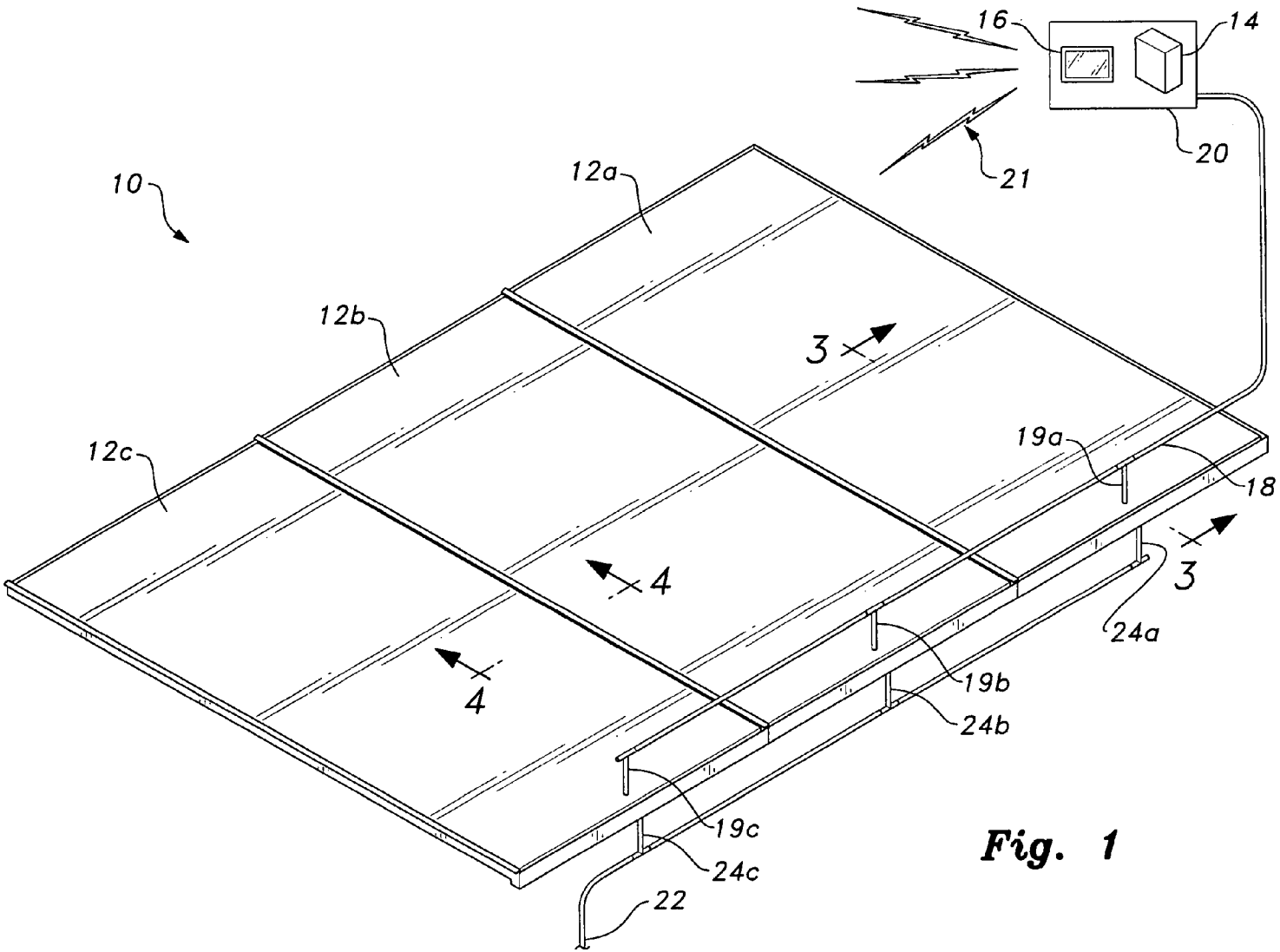
FIG. 1 is an environmental, perspective view of a condensation-free and bacteria-free pan system according to the present invention.

The condensation-free and bacteria-free pan system, generally indicated by the numeral 10 in the drawings, prevents condensation and kills bacteria over a production line or food preparation area in commercial and industrial food and beverage plants or establishments without the use of harsh or toxic chemicals. System 10 may be used to protect any production line or food preparation area in the food and beverage industries where food goes through a cooking process. As shown in FIG. 1, the system 10 may include multiple pans 12*a*, 12*b*, 12*c* that are interlocking and can be customized to fit any project, length, width, area, or need.

Although the system 10 is described for safety in the food preparation industries, it should be understood that the system 10 may be used wherever it is necessary or desirable to heat materials in a condensation-free and bacteria-free environment, such as in the medical or pharmaceutical fields. Further, it should be understood that the number of pans (three pans 12*a*, 12*b* and 12*c* in FIG. 1) is shown in the drawings for exemplary purposes only, and that any desired number of pans may be used. Up to fifty such pans, for example, may be used. Further, the particular relative dimensions and configuration of the pans 12*a*, 12*b* and 12*c* are shown in the drawings for exemplary purposes only.

The condensation and bacteria-free pans 12*a*, 12*b*, 12*c* of system 10 may be formed from stainless steel or any other suitable corrosion resistant material. The system 10 includes a controller 14, which may be any suitable type of controller, such as a computer or a programmable logic controller. For example, the controller 14 may be an Allen-Bradley MicroLogix 1200 or SLC 500, manufactured by Rockwell Automation, Inc. It should be understood that the type, configuration and size of controller 14 depends upon the number of pans required by the production line. Thus, the Allen-Bradley controller 14 is merely representative of a type of controller used in the preferred embodiment.

An Allen-Bradley PanelView Plus™ 1000 (also a product of Rockwell Automation, Inc.) ten-inch color LCD touch screen 16 is preferably connected to the controller 14. It should be understood that any suitable type of display and/or user interface may be utilized, and that the touch screen 16 is only an example of one type of combined display and interface. The controller 14 and the touch screen 16 are shown diagrammatically in FIG. 1, it being understood that the exact mounting or positioning of components 14 and 16 depends upon the production line or food preparation area.

Wiring from the condensation and bacteria-free pans 12*a*, 12*b*, 12*c* is routed into a main electrical connection conduit 18. Each pan 12*a*, 12*b*, 12*c* has its own readily detachable subconduit 19*a*, 19*b*, 19*c*, respectively, that connects to main electrical connection conduit 18. From the main electrical connection conduit 18, the wiring feeds into a control panel 20 that houses the controller 14, the touch screen 16, and any other desired control components, as shown in FIG. 1. As noted above, the controller 14 and touch screen 16 are shown in FIG. 1 for exemplary and illustrative purposes only, and controller 14 and touch screen 16 may, alternatively, be located in separate and distinct positions, depending upon the environment. However, in the preferred embodiment, the components 14 and 16 are mounted in a single housing or, more specifically, the control panel 20, for easy access.

The controls for the condensation/bacteria-free pans 12*a*, 12*b*, 12*c* have a multitude of possible arrangements available, due mostly to individual customer request and/or applications. As previously noted, the single cabinet or control panel 20 may be built as large as necessary to house the electrical components. In one application, as an example, there could be a new factory being built, and one single control point can be installed for hundreds of the condensation/bacteria-free pans 12*a*, 12*b*, 12*c*. It should be understood that there could be many different sizes of controllers, such as controller 14, used in the system 10. The types of controller, interfaces, displays, and the overall configuration of system 10, including the number, shape and size of the pans, depend upon the environment and the use of the system 10. Thus, a single controller 14 could control between one and a hundred of pans, for example, and the panel view 16 could interface with one or multiple pans, as needed.

Alternatively, a particular application of system 10 may require only a single bacteria-free pan and a corresponding controller with a much more simple design. In this alternative, a thermal PID loop controller could replace the controller 14 for each single unit. As a further alternative, the thermal PID loop controller could replace either the Allen-Bradley MicroLogix 1200 or SLC 500 controllers. This smaller type of design is based on the cost of the controller, as compared to the cost of the thermal PID loop controller. At the four-unit to five-unit range, the cost-effectiveness of the single unit controller surpasses the cost of a single controller for a group of the condensation and bacteria-free pans 12*a*, 12*b*, 12*c*.

System 10, equipped with the above-described Allen-Bradley MicroLogix 1200 or SLC 500 controllers or similar controllers, has many optional functions available. These controllers permit a networking option, wherein multiple standalone arrays are connected together. In addition, one or all of the units can be connected to a monitoring point. Typical monitoring points could be located in a local office, a maintenance department, a remote office or headquarters, and even the U.S. Department of Agriculture (USDA). With the system 10 so equipped, networking into the system 10 to receive e-mails, control signals, or other information, generally indicated as diagrammatic signals by numeral 21 in FIG. 1, is relatively easy. The signals 21 may include an indication or alarm that pan conditions are such that bacterial growth is forming or condensation is being collected therein. Thus, the e-mails or other communications carried by signals 21 can include system reports or failure reports that also can be printed locally.

The system 10 has a power consumption monitor feature that can trend the use of kilowatt-hours (KWH) used and cost per hour to run the system 10. This option allows for individual tuning of the system 10 for maximum efficiency because each condensation and bacteria-free pan 12*a*, 12*b*, 12*c* of the system 10 operates on 480 V, single-phase power, pulling nine amps each during a heat cycle (as an example). The system 10 operates as a real-time system that can run based on individual scheduling. In other words, the system 10 can be set in real clock time, including being set to run at specific times and being set to shut off at specific times. This allows for maximum efficiency and also eliminates any need of operator input.

Additionally, each pan 12*a*, 12*b*, 12*c* is connected to a main overpan drip line 22. This drip line 22 is individually and detachably connected to each pan 12*a*, 12*b*, 12*c* with a drip drain 24*a*, 24*b*, 24*c*. The overpan drip line 22 will be explained in more detail below, with particular reference to FIG. 3.

The temperature of each pan 12*a*, 12*b*, 12*c* has adjustable set points according to conditions in the environment for eliminating condensation. The pans 12*a*, 12*b*, 12*c* are controlled by the controller 14, which preferably has a ladder logic program programmed thereon, that randomly heats each of the pans 12*a*, 12*b*, 12*c* to keep the overall power demand down for a more energy efficient system. Further, the condensation and bacteria-free pans 12*a*, 12*b*, 12*c* can be ramped to a high preset temperature for a preset time to kill any bacterial growth that is not desired. *Listeria, E. coli*, and *salmonella* are examples of major bacteria and viruses that affect or upset the food industry. The condensation-free and bacteria-free pan system 10 eliminates these bacteria, along with many others, over a food production line. There is further an automatic set-point control option that includes thermal monitoring of the ambient temperature of the controlled area, as well as an auto-setting of the temperature of the condensation-free and bacteria-free pan system 10, thus preventing condensation by controlling a condition that varies while eliminating the need of operator input.

Each condensation and bacteria-free pan is positioned at an angle when it is secured above the food preparation area so that the pans 12*a*, 12*b*, 12*c* serve to collect overhead debris and drippings. The pans 12*a*, 12*b*, 12*c* can also be linked or releasably locked together to form any length or width of overhead shielding that is desired. A typical pan may be approximately forty-four inches by ninety inches and is substantially rectangular. The top of each pan also serves as a drip pan.

Figure 2:
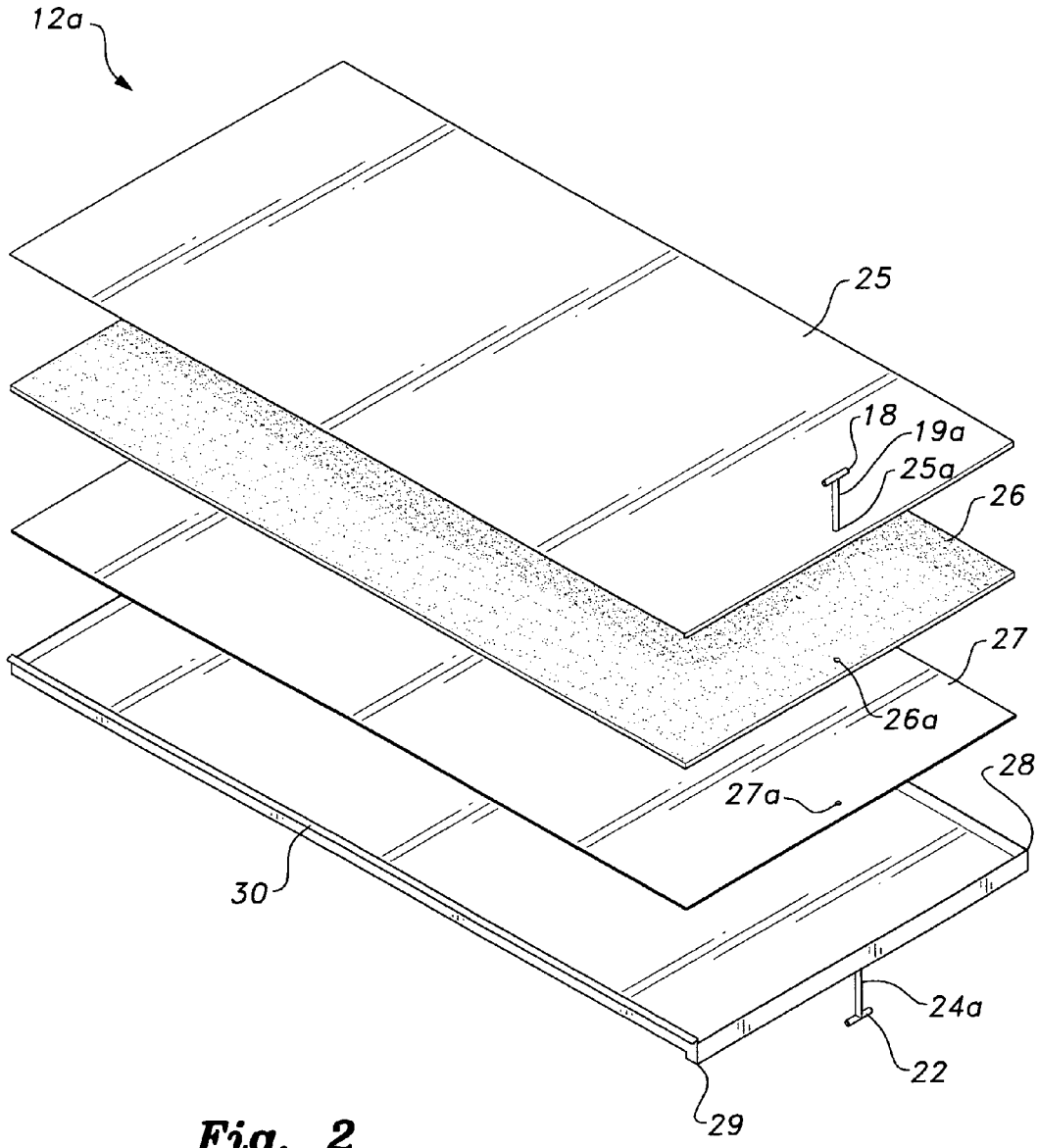
FIG. 2 is an exploded view of a single pan of the condensation-free and bacteria-free pan system according to the present invention.

As shown in FIG. 2, each pan preferably has four layers, including a bottom pan sheet 28, which may be formed from stainless steel, a heating element layer 27, a layer of insulation 26, and a top cover sheet 25, which may also be formed from stainless steel. The four layers are laminated or otherwise joined together to form the pan (pan 12*a* in FIG. 2, though it should be understood that all pans of the system are substantially identical).

The top cover sheet 25 is designed to act as a drip catcher for catching any inadvertent drips or debris that may accumulate and drop from overhead. The top cover 25 is not heated, and remains at room temperature. An insulating layer 26 is mounted below the top cover 25, sandwiched between top cover 25 and heating element 27. The heating element 27 is electrically connected to control electronics through the readily detachable subconduit 19*a*, which passes through openings 25*a* and 26*a*, connecting to the heating element 27 at connection point 27*a*. The readily detachable subconduit 19*a* is detachably connected to main conduit 18. The heating element 27 may include a thermocouple connected thereto that can be monitored and regulated by controller 14.

The heating element 27 is disposed below the inner cover 25 and the insulating layer 26. The heated bottom pan sheet 28 encloses most of the other members 25, 26, and 27 of the overall pan 12*a*, and the bottom pan sheet 28 lies a short distance above the food preparation area when installed. The heated bottom pan sheet 28 further includes an over-drip trough 29. The trough 29 is very similar to a conventional gutter in function and construction. The pan 12*a* is tilted toward the trough 29 so that any water condensation or debris from overhead will make its way to the trough 29, drain through the drip drain 24*a*, and pass though the overpan drip line 22.

The bottom pan 28 is heated by the heating element 27 so that the surface of the bottom pan sheet 28 can be adjusted to a higher temperature. This function serves to kill bacteria, such as *listeria, salmonella*, and *E. Coli* that come in contact with the surface of the bottom heated pan 28. These germs can form on overhead surfaces of food processing or preparation areas due to debris or meat juices being sprayed from equipment, sanitation, or even blown from a fan. The heating element 27 of the pan 12*a* can be adjusted to varying temperatures that enable the heating element 27 to be used to kill bacteria and prevent condensation. The heating element 27 serves as an internal heating blanket and preferably has a "J" thermocouple installed to control temperature. The heating element 27 or blanket is between the high temperature insulation 26 and the stainless steel of the bottom pan sheet 28.

Figure 3:
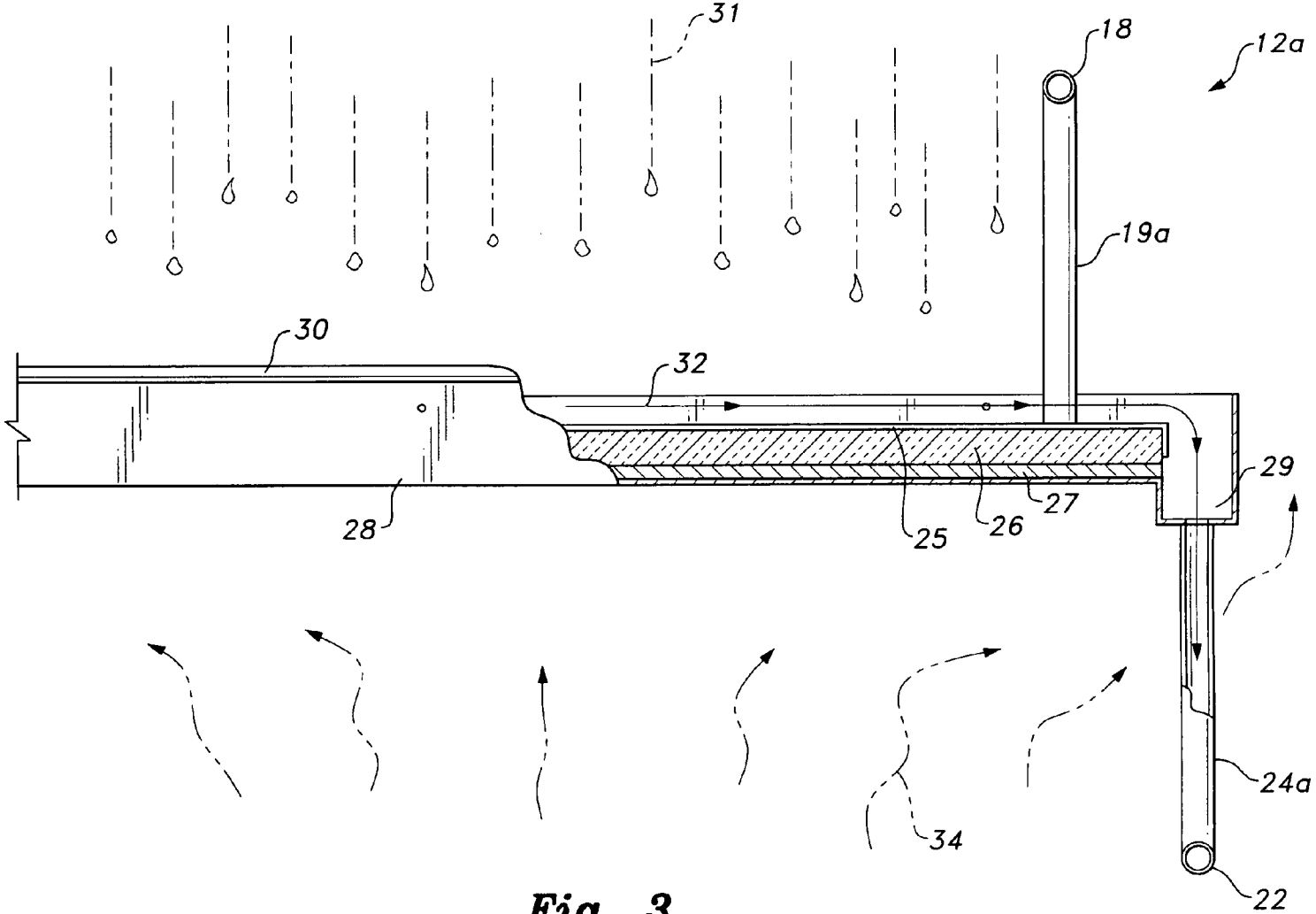
FIG. 3 is a section view drawn along lines 3-3 of FIG. 1.

As shown in FIG. 3, a majority of matter that drips onto top cover sheet 25 is typically in the form of moisture droplets 31. The moisture droplets 31 drain into the trough 29, following path 32, and then into the associated drain 24*a*, and then into the overpan drip line 22. This drainage system is arranged to allow for the draining away of the condensed moisture 31 that has collected on the top cover 25 of pan 12*a*. The heating element 27 can be adjusted to a desired temperature, and is designed to prevent condensation from forming on the pan bottom sheet 28.

Steam 34 that rises from cooking of foods in the food preparation area normally rises and condenses on any overhead surface, but the condensation/bacteria-free pan system 10 is designed to heat bottom pan sheet 28 to a temperature comparable to the steam so that the rising steam 34 avoids the heated surface of the bottom pan sheet 28 as it rises, with the steam being diverted around the pan 12*a* by the heated air directly beneath layer 28. The steam 34 may condense above pan 12*a* and drip onto the top cover 25 of the pan 12*a*, where the moisture 31 flows (as indicated by the arrows 32) into the trough 29, down the drain 24*a*, and into the overpan drip line 22. Thus, condensation due to the steam 34 from cooked foods, and hence contamination, is thereby avoided on the heated bottom pan sheet 28.

Figure 4:
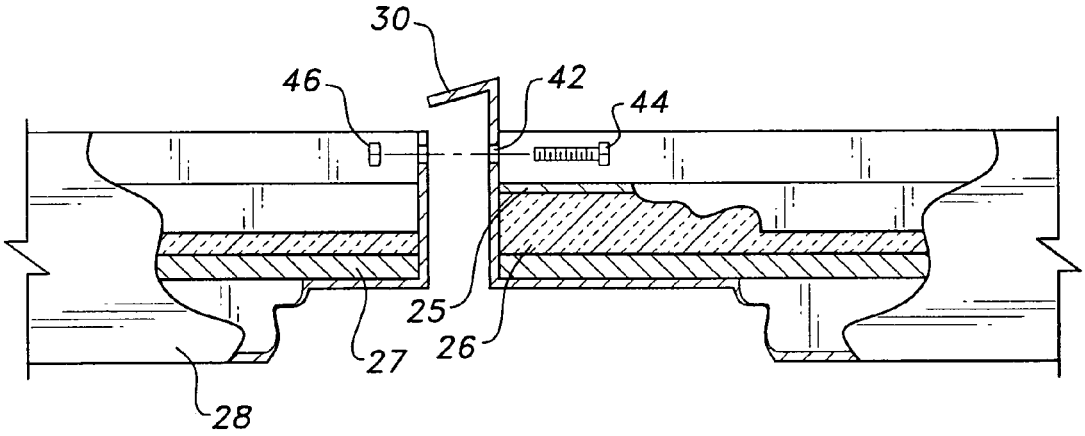
FIG. 4 is a section view drawn along lines 4-4 of FIG. 1.

As shown in FIG. 4, each pan 12*a*, 12*b*, 12*c* has a vertical sidewall and an opposing sidewall 30 having an inverted J-shape. The J-shaped sidewall 30 has a top flange that overlays the junction between the sidewalls of adjacent pans 12*a*, 12*b*, 12*c* when the pans are joined together so that any drips or condensation will be diverted into the neighboring pan instead of seeping through the joint between the sidewalls. Each sidewall is attached by way of aperture 42 with a standard bolt pattern, such as exemplary bolt 44 and mating nut 46.

The condensation-free and bacteria-free pan system 10 is automated, self-sufficient, and virtually contamination-free. The condensation-free and bacteria-free pan system 10 eliminates a need for costly condensation collection crews. The pans are self-drying, thus no wiping is needed (wiping would cause unnecessary spreading of bacteria in the system). The equipment used by work crews on overhead objects, such as ceilings, water pipes, conduits, ductwork, etc., often contains water droplets and/or bacteria-infested debris that occasionally fall and contaminate food and beverage products. The condensation-free and bacteria-free pan system 10 eliminates this safety violation, reduces operating expenses, loss of product due to contamination, and promotes a clean, safe, and healthy food product. Pans 12*a*, 12*b* and 12*c* may be suspended from the ceiling, or above the work surface, by any suitable support or suspension mechanism.

The units described above are typical. The units are "built to suit" and can be typical or any size or shape within manufacturing capacity. The installations shown are typical. The units can be mounted "to suit" and can be used for many different locations or arrangements, for example, but not limited to, inside conveyor tunnels, under air control units, temperature bacteria walls, and many other applications where a difference in temperature causes unwanted condensation and bacteria.

It is to be understood that the present invention is not limited to the embodiment described above, but encompasses any and all embodiments within the scope of the following claims.

I claim:

1. A condensation-free and bacteria-free pan system, comprising:

at least one pan having multiple layers, including:

a top cover sheet adapted for catching contaminants falling from overhead;

a layer of thermal insulation positioned below the top cover sheet;

a heating element positioned below the layer of thermal insulation; and a bottom pan sheet made of thermally conductive material, bottom pan sheet having a lower wall and at least one sidewall, the top cover sheet, the layer of thermal insulation, the heating element, and the bottom pan sheet being joined together to form the pan; and a controller electrically connected to the heating element for randomly heating the at least one pan to eliminate bacteria and reduce condensation collecting on the bottom pan sheet when the pan is mounted above a work area.

2. The condensation-free and bacteria-free pan system as recited in claim 1, wherein said controller comprises a programmable logic controller.

3. The condensation-free and bacteria-free pan system as recited in claim 2, further comprising a touch screen user interface connected to said programmable logic controller.

4. The condensation-free and bacteria-free pan system as recited in claim 2, wherein said programmable logic controller is connected to a communications network for remote operation.

5. The condensation-free and bacteria-free pan system as recited in claim 1, wherein said controller comprises a thermal PID loop controller.

6. The condensation-free and bacteria-free pan system as recited in claim 1, wherein said controller is programmable to a user-selectable temperature for user-selectable time intervals.

7. The condensation-free and bacteria-free pan system as recited in claim 1, wherein said bottom pan sheet is rectangular, having a pair of laterally opposed sidewalls and a pair of longitudinally opposed sidewalls.

8. The condensation-free and bacteria-free pan system as recited in claim 7, wherein one of said longitudinally opposed sidewalls is substantially J-shaped, forming a trough for receiving the contaminants.

9. The condensation-free and bacteria-free pan system as recited in claim 8, further comprising a drainage pipe in communication with the trough for draining the contaminants.

10. The condensation-free and bacteria-free pan system as recited in claim 9, wherein the at least one pan comprises a plurality of pans, each said drainage pipe draining into a single drainage conduit.

11. The condensation-free and bacteria-free pan system as recited in claim 10, further comprising means for securing adjacent pairs of the pans to one another.

12. The condensation-free and bacteria-free pan system as recited in claim 10, wherein one of the laterally opposed sidewalls of each said pan has a substantially inverted J-shape defining a top flange and overlapping flange extending over the sidewall of an adjacent one of the pans to couple the pans together.

13. The condensation-free and bacteria-free pan system as recited in claim 1, further comprising an electrical conduit mounted on the top cover sheet, the electrical conduit housing electrical lines in communication with said heating element and said controller.

14. A condensation-free and bacteria-free pan system, comprising:

a plurality of interlocking multilayer pans, each of the pans having:

a bottom pan sheet having a flat floor made of thermally conductive material and peripheral sidewalls surrounding the floor, the peripheral sidewalls including a mounting sidewall adapted for attaching the pan to a vertical support surface between an overhead structure and a work area with the pan sloping downward away from the support surface, a J-shaped sidewall forming a trough opposite the mounting sidewall, and opposing connector sidewalls connecting the mounting sidewall with the J-shaped sidewall;

an electrical heating element disposed on the floor of the bottom pan sheet;

a layer of thermal insulation disposed on the heating element; and a top cover sheet disposed on the layer of thermal insulation, the top cover sheet forming a drip pan to convey contaminants dripping from the overhead structure to the trough to protect the work area, the layer of thermal insulation insulating the top cover sheet from the heating element to keep the top cover sheet at room temperature; and a controller electrically connected to the heating element of each of the pans, the controller being programmed to periodically turn the heating element on to heat the bottom pan sheet to a programmable temperature to kill microorganisms and evaporate condensation rising from the work area to the pans;

a plurality of drip drains, each of the pans having one of the drip drains depending therefrom; and a common drip line forming a single conduit, each of the drip drains emptying into the drip line, the drip line carrying contaminants collecting in the trough away from the work area below the plurality of interlocking pans.

15. The condensation-free and bacteria-free pan system according to claim 14, wherein said controller comprises a programmable logic controller.

16. The condensation-free and bacteria-free pan system as recited in claim 15, further comprising a touch screen user interface connected to said programmable logic controller.

17. The condensation-free and bacteria-free pan system as recited in claim 15, wherein said programmable logic controller is connected to a communications network for remote operation.

18. The condensation-free and bacteria-free pan system as recited in claim 14, wherein said controller comprises a thermal PID loop controller.

19. The condensation-free and bacteria-free pan system as recited in claim 14, wherein each said top cover sheet and each said bottom pan sheet is made from stainless steel.

20. The condensation-free and bacteria-free pan system as recited in claim 14, wherein one of the connector sidewalls of each said bottom pan sheet forms a hook closely fitting over one of the connector sidewalls of the adjacent bottom pan sheet to interlock the pans together.

* * * * *